US005636397A

United States Patent [19]

Boyd et al.

[11] Patent Number: 5,636,397

[45] Date of Patent: Jun. 10, 1997

[54] FUTON MATTRESS

[76] Inventors: Terence J. Boyd, 5828 W. Bald Eagle Blvd., White Bear Lake, Minn. 55110; Chet Stoler, 3078 W. Owasso Blvd., Roseville, Minn. 55113

[21] Appl. No.: 203,428

[22] Filed: Mar. 1, 1994

[51] Int. Cl.[6] ..... A47C 27/14

[52] U.S. Cl. ..... 5/739; 5/740

[58] Field of Search ..... 5/464, 471, 472, 5/474, 478, 481; 52/524; 29/91.1, 91.2, 91.5

[56] References Cited

U.S. PATENT DOCUMENTS

| | | | |
|---|---|---|---|
| 2,749,690 | 6/1956 | Bridges | 53/524 |
| 3,287,748 | 11/1966 | Trogdon et al. | 5/474 |
| 3,611,524 | 10/1971 | Broyles | 29/91.1 X |
| 4,086,675 | 5/1978 | Talbert et al. | 5/474 |
| 4,251,975 | 2/1981 | Krein | 53/524 X |
| 4,276,666 | 7/1981 | Yamada | 5/481 |
| 4,606,088 | 8/1986 | Michaelson et al. | 5/481 X |
| 4,794,658 | 1/1989 | Goodale . | |
| 4,975,996 | 12/1990 | Evans et al. | 5/481 |

FOREIGN PATENT DOCUMENTS

| | | | |
|---|---|---|---|
| 546874 | 8/1942 | United Kingdom | 5/401 |

*Primary Examiner*—Michael F. Trettel
*Attorney, Agent, or Firm*—Jacobson & Johnson

[57] ABSTRACT

A futon mattress construction including at least one end cap formed of a flexible, deformable material that is resistant to flattening, a means for retaining the end cap near an edge of the mattress and at least two layers of batting encasing the flexible, deformable members and enclosed in a protective cover is disclosed. A method of manufacturing the futon mattress is also disclosed.

15 Claims, 4 Drawing Sheets

FUTON MATTRESS

BACKGROUND OF THE INVENTION

The present invention relates to futon furniture. In particular, the present invention relates to a novel futon mattress construction and a method of manufacturing a futon mattress.

Futon furniture in recent years has become a popular alternative to standard upholstered furniture. Futon couches, loveseats and chairs can be repositioned so that the furniture can be used as a bed. Futon beds that do not convert into seats or couches are also commercially available.

The cost of futon furniture varies widely. Because of the wide variability in the cost of the futon frame, mattress and decorative coverings, futon furniture appeals to a wide range of purchasers. The unique appearance, dual functionality and in some instances low cost of futon furniture has resulted in rapid growth in the industry.

A "futon mattress" for purposes of this disclosure is a mattress formed by a cloth covering that is filled at least in part with a batting of cotton, a synthetic fiber such as polyester or a blend of cotton and a synthetic fiber. Futon mattresses are firmer than many styles of standard inner-spring mattresses. Some consumers prefer to sleep on softer surfaces.

In order to broaden market appeal for futon furniture, manufacturers have developed futon mattresses having a layer of flexible foam positioned within the batting. For example, a futon mattress having a three inch thick solid flat sheet of foam positioned between separate sheets of batting is currently available. The foam sheet is totally enclosed within the batting.

Another even softer futon mattress construction was developed by inserting one or more layers of a foam sheet having at least one convoluted major surface between the layers of batting. "Convoluted" for purposes of this disclosure refers to a contoured surface with raised portions and valleys that has the appearance of an egg crate. As with the mattress described above utilizing a solid foam sheet, the batting completely surrounds the foam. The convolutions help give the mattress a softer, more flexible feel than the feel of futon mattresses employing solid foam sheets.

Futon mattresses which are formed from fiber batting alone or which employ in combination with the batting either the solid foam sheets or the convoluted sheets have disadvantages. When the futon furniture is in the upright or sitting position, the front edge of the seat portion of the mattress tends to flatten over time. The front edge flattens because the batting settles, and also the foam inner layer flattens with use. The flattened front edges do not provide sufficient leg support and the futon furniture becomes less comfortable for the user. Additionally, futon mattresses with flattened front edges appear worn.

Not only does the front edge flatten with time, but often the edge which supports the user's head in the upright as well as lowered position also flattens with use. The edge nearest the user's head also eventually fails to provide adequate support.

SUMMARY OF THE INVENTION

The present invention is a futon mattress comprising at least two layers of batting. A means for preventing flattening of at least one region near an edge comprising at least one flexible, deformable elongated member is also included. A retaining means for retaining each elongated member proximate an edge of the mattress and a cover enclosing the batting, each flexible elongated member and retaining means is disclosed.

A method of forming a futon mattress is disclosed. The method includes a step of providing at least one sheet of flexible, deformable material, each sheet having a first and second opposite edge. The method includes a step of providing at least one elongated end cap formed from a flexible, deformable material that is resistant to flattening. The elongated end cap has a substantially flat connecting surface. The method includes fixedly connecting each end cap at the connecting surface to each first edge of each sheet, forming a core assembly. The method further includes the step of providing at least two layers of fibrous batting and positioning the core assembly between the layers of batting. The layers are compressed and inserted into a cover. The cover is closed to form a futon mattress.

DETAILED DESCRIPTION

The present invention is a novel futon mattress which has at least one edge that is resistant to flattening and wear.

Figure 1:
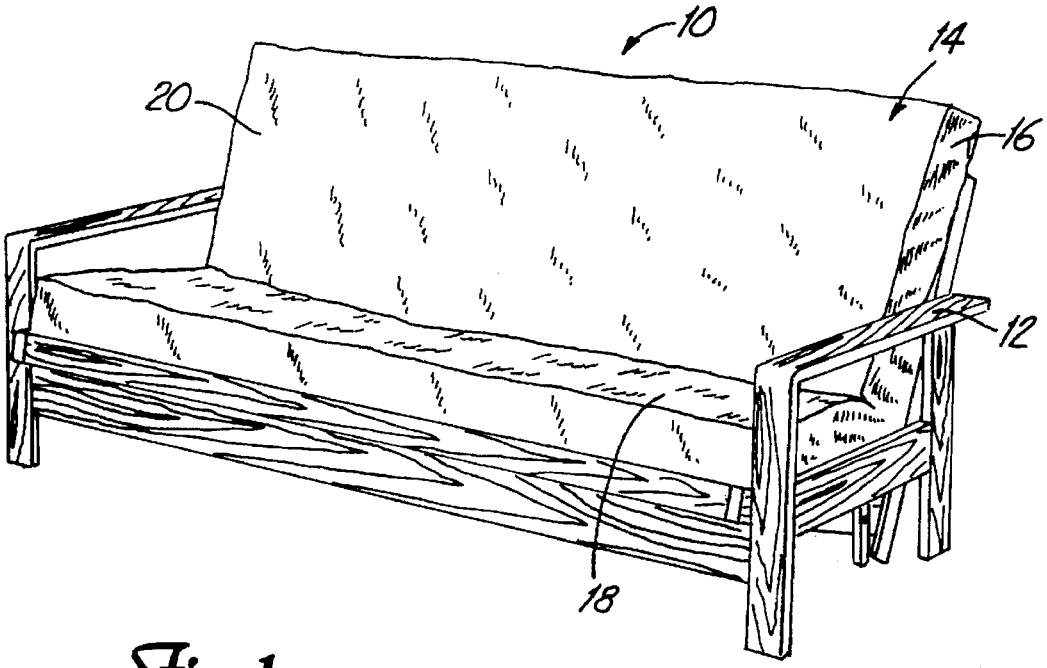
FIG. 1 is a perspective view of a futon couch including the futon mattress of the present invention.

A perspective view of a futon couch including the futon mattress of the present invention is shown in FIG. 1. The futon couch 10 includes a movable frame 12, a futon mattress 14 and a decorative mattress cover 16. The mattress cover 16 encases and protects the mattress 14. Although the futon mattress of the present invention can be supported by a futon couch frame 12 as shown in FIG. 1, the futon mattress 14 of the present invention is also suitable for use on chair, love seat, ottoman, bed, bunk bed and cot frames, for example.

The moveable frame 12, as shown in FIG. 1, has a seat portion 18 and a backrest portion 20. The backrest portion 20 is shown in an upright position in FIG. 1. The backrest portion 20 may be lowered to a horizontal position (not shown) so that the futon couch 10 can be used as a bed.

Figure 2:
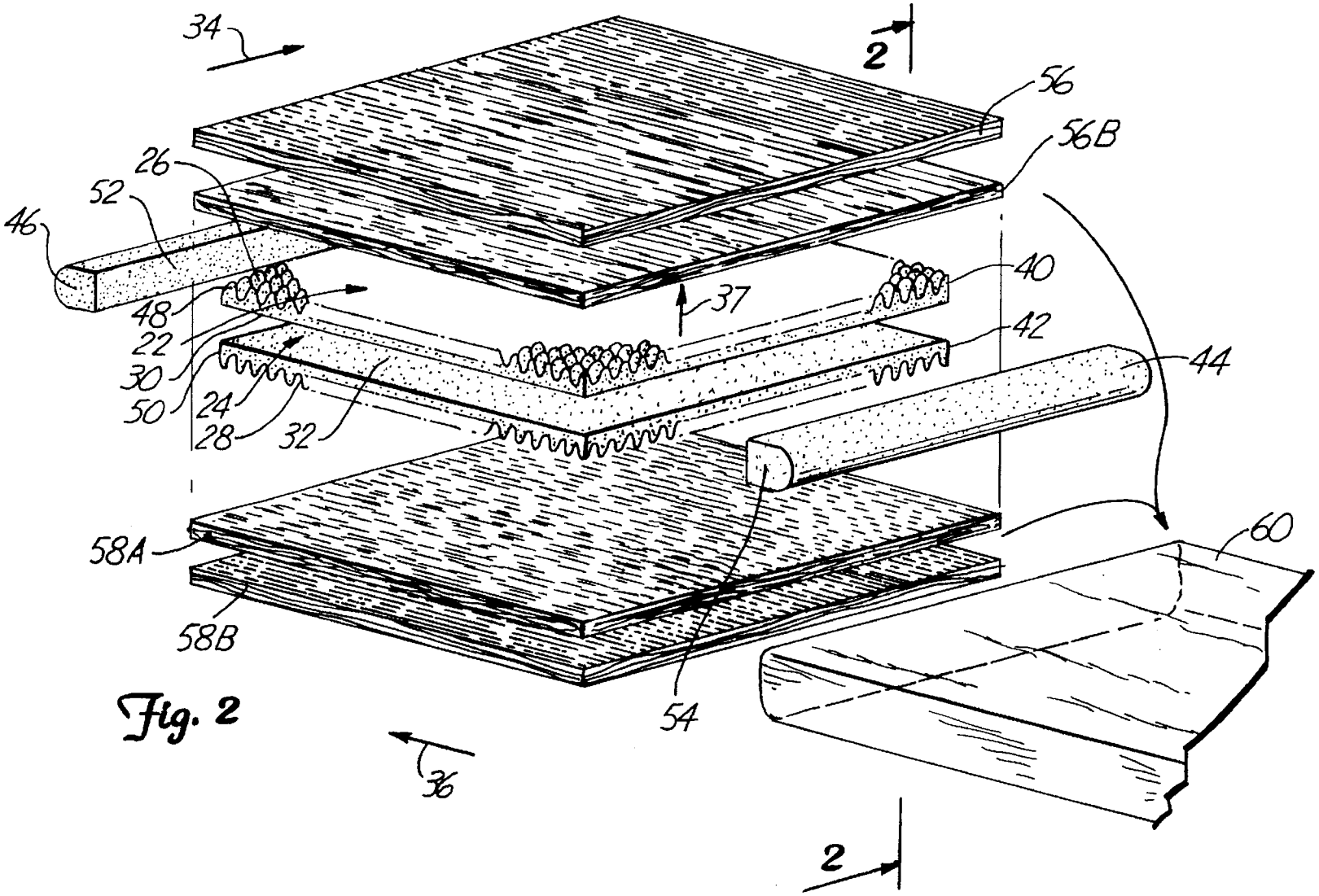
FIG. 2 is an exploded perspective view of the futon mattress of the present invention.

An exploded perspective view of the futon mattress of the present invention is illustrated in FIG. 2. The futon mattress of the preferred embodiment includes a means for preventing flattening of at least one region of the mattress near an edge which in the preferred embodiment are end caps 44 and 46 and which are described in greater detail below. The present invention also includes a retaining means for retaining each elongated member within and proximate an edge. The preferred retaining means is a pair of convoluted sheets 22 and 24. Each convoluted sheet 22 and 24 has a convoluted major surface 26 and 28 and a substantially flat major surface 30 and 32.

In the preferred embodiment, each convoluted sheet 22 and 24 is positioned such that the major flat surfaces 30 and 32 are face to face. In the preferred embodiment, the convoluted sheets 22 and 24 are unbonded at their major flat surfaces 30 and 32, respectively. However, providing a bond, such as an adhesive bond, is contemplated by the present invention.

The preferred convoluted sheets 22 and 24 are constructed of a urethane foam having a density of approximately one pound per cubic foot. The preferred foam has an indention force deflection (hereinafter I.F.D.) of approximately 25 pounds. The distance between a valley and a peak of each convolution in a direction shown by arrow 37 in the preferred embodiment is approximately one and three-quarters inches. A thickness of each sheet 22 and 24 measured from a valley to an opposite major surface is approximately ½ inch. The peak-to-peak distance in a first direction 34 is approximately one and three-quarters inches and the peak-to-peak distance in a second direction 36 is approximately two inches in the preferred embodiment. This product is available from Federal Foam Technologies of Elseworth, Wis.

Although in the preferred embodiment the surfaces 26 and 28 are convoluted, the present invention contemplates the use of a foam sheet with two flat major surfaces or one flat major surface and a major surface having a contour that differs from the convoluted surface shown.

Each convoluted sheet 22 and 24 has a first longitudinal edge 40 and 42 positioned adjacent and laminated to the means for preventing flattening which in the preferred embodiment are end caps 44 and 46. End cap 44 is preferably formed of a urethane foam material having a density of between about 1.5 and about 2.1 pounds per cubic foot and an I.F.D. of between about 30 and 40. Preferably, the density is about 1.8 pounds per cubic foot and the I.F.D. is approximately 34.

In the preferred embodiment, a second end cap 46 is provided on an opposite end of convoluted sheets 22 and 24. Convoluted sheets 22 and 24 include opposite longitudinal edges 48 and 50 which are positioned adjacent and adhesively connected to the second end cap 46.

In the preferred embodiment, a solvent-based adhesive sold under the trade name "Kwikstix 1576" and available from Columbia Cement Company, Inc. of Freeport, N.Y. is used to laminate end caps 44 and 46 to the convoluted sheets 22 and 24, respectively. Preferably, the adhesive is sprayed onto a connecting surface 52 and 54, as well as the longitudinal edges 40, 42, 48 and 50. The edges 40 and 42 are held against connecting surface 54 until a bond is formed. Preferably, the bond is formed instantaneously. Similarly, edges 48 and 50 are held against connecting surface 52 until a permanent bond is formed. Although "Kwikstix 1576" is a solvent-based adhesive, the present invention contemplates the use of water-based adhesives, heat sealing techniques and mechanical attachment means.

The present invention includes at least two layers of batting which enclose the end caps and retaining means. In the preferred embodiment, two fibrous bats 56A, 56B, and 58A and 58B are positioned on either side of convoluted surfaces 26 and 28. Fibrous bats 56A, 56B and 58A, 58B are preferably formed from a blend of cotton and polyester. Preferably, the batting is 25% polyester and 75% cotton and is available from Airtex of Minneapolis, Minn.

In a standard full-size mattress, the overall dimensions are approximately 54 inches by 75 inches by 8 inches thick. The thickness is measured from top of crown to top of crown and varies slightly. These standard sizes are recognized by the International Standard Bedding Association ("ISBA"). In a full-size mattress of the preferred embodiment, each of the four bats 56A, 56B, 58A and 58B weighs approximately ten pounds.

Preferably, the batting 56A, 56B and 58A, 58B is positioned such that the convoluted sheets 22 and 24, as well as the end caps 44 and 46, are completely encased within the batting.

The present invention also includes a cover 60 which encloses the batting, each flexible elongated member and retaining means. In the preferred embodiment, the batting, 56A, 56B, 58A and 58B, convoluted sheets 22 and 24 and end caps 44 and 46 are protected within the casing 60. Preferably, the casing 60 is formed of 65% cotton and 35% polyester. Most preferably, the casing material is seven ounce weight.

Figure 3:
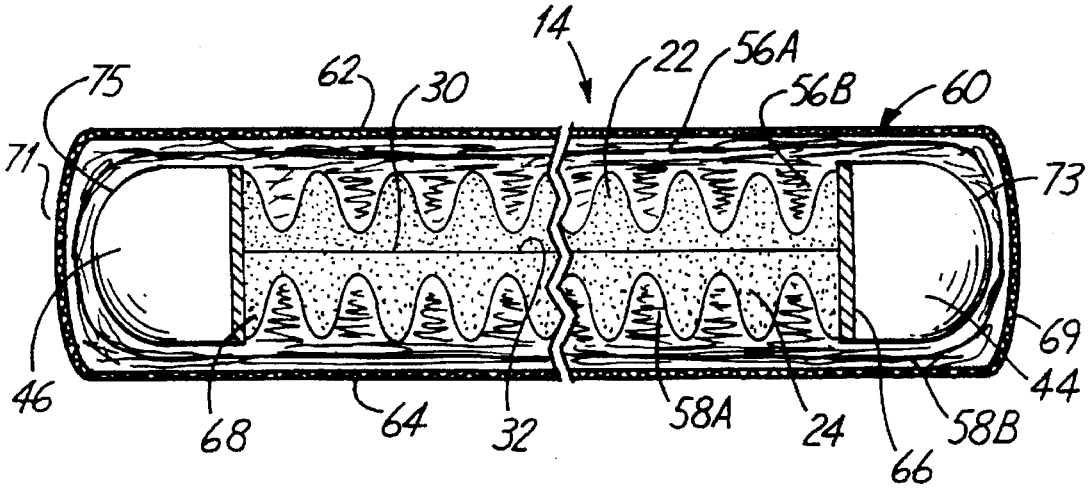
FIG. 3 is a partial cross-sectional view of the futon mattress of the present invention.

A cross-sectional view of the futon mattress of the present invention, taken along lines 2—2, as shown in FIG. 2, is illustrated in FIG. 3. Preferably, convoluted sheets 22 and 24 are arranged with flat major surfaces 30 and 32 face to face (shown in FIG. 2). Preferably, convoluted sheets 22 and 24 are held together by the casing 60, as well as tufting (not shown) extending from an upper layer 62 of casing 60 through the batting 56A, 56B, convoluted sheets 22 and 24, batting 58A, 58B and lower layer 64 of casing 60.

The adhesive layer 66 and 68 formed within the mattress are a part of a preferred means for retaining each end cap 44, 46 proximate an edge 69, 71 of the mattress 14.

The end caps 44 and 46 in the preferred embodiment are positioned within the mattress such that when the mattress is in use, one end cap is located at the front edge of the seat cushion and a second is located at the edge forming the upper-most portion of the backrest when the futon is in the upright, or sitting position.

The end caps 44 and 46 are preferably formed of a urethane foam material which is denser than the material used to form the convoluted sheets 22 and 24. The I.F.D. of the end cap material is preferably between about 30 and about 40. The end caps are also preferably formed of a fire-retardant material that meets the "Calspec" fireproof standards. The preferred material of construction for the end caps 44 and 46 is 1.8 pound per cubic foot density, 34 I.F.D. Calspec urethane foam available from Federal Foam Technologies of Elseworth, Wis. A density between about 1.5 and about 2.1 would be suitable for forming the end caps.

Preferably, foam end caps 44 and 46 have contoured outer surfaces 73 and 75. Although other shapes could be used, preferably an outer surface 73 and 75 that is continuous and curved is used to form the end caps of the present invention.

It is desirable to use fire-retardant material to form end caps 44 and 46, although it is not required. Preferably, the end caps are formed of a fire-retardant material in the event that the batting 56A, 56B, 58A, 58B shifts, exposing end caps 44 and 46 to the outer casing 60. Although it is preferable to select materials that are fire-retardant, it is not necessary to use fire-retardant materials to form convoluted sheets 22 and 24 and end caps 44 and 46 because components 22, 24, 44 and 46 are completely encased within fire retardant batting 56A, 56B, 58A and 58B.

Figure 4:
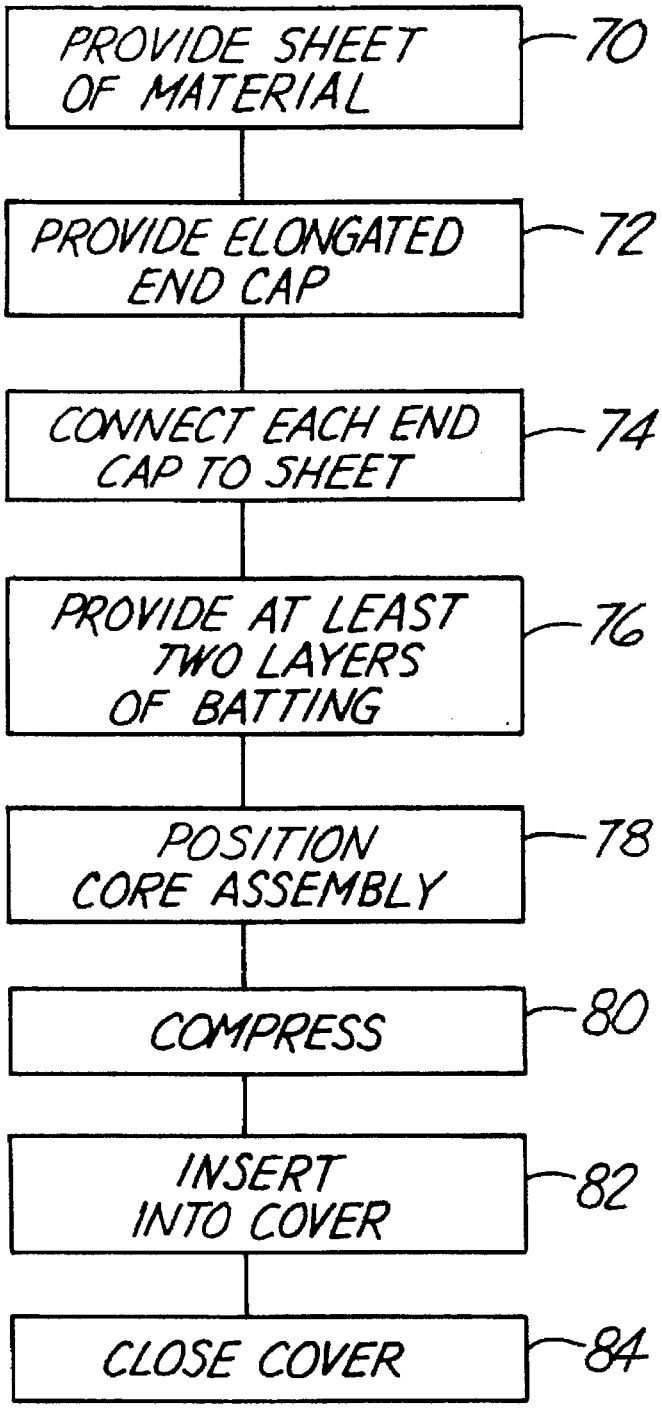
FIG. 4 is a flow diagram outlining the process steps of the method of the present invention.

FIG. 4 is a flow diagram illustrating the method of the present invention. In the method, at least one sheet of a flexible material that is deformable and has first and second opposite elongated edges is provided 70. Preferably, two sheets of urethane foam are provided. The sheets each preferably have a first smooth major surface and an opposite convoluted major surface. The sheets are preferably positioned with flat major surfaces in face to face contact. Next, at least one elongated end cap is provided 72, preferably having a length equal to a length of the longitudinal edges of the adjacent foam sheets. Preferably, each end cap has an elongated flat surface and a smooth, continuous outer surface, free of sharp edges. Next, a longitudinal edge of each foam sheet is fixedly connected 74 to the flat surface of the end cap. Preferably, the foam sheet and end cap are bonded by means of a spray adhesive which forms a permanent bond upon contact.

The method of the present invention further includes the step of providing at least two layers of fibrous batting 76. Most preferably, four layers of batting are provided. At least one sheet of batting is positioned above the foam sheet and end cap and at least one sheet of batting is positioned below the foam sheet and end cap. Preferably, two cotton-poly bats are positioned 78 on each side of the foam sheets and end cap, hereinafter referred to as the "foam core assembly."

Figure 5:
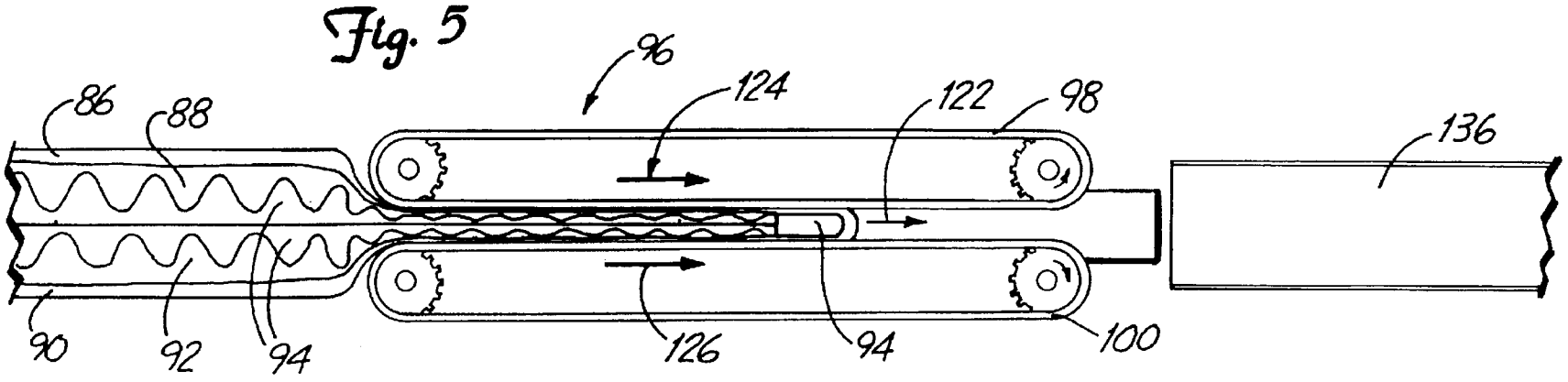
FIG. 5 is a schematic side view of the compression step of the method of the present invention.

Referring now to FIG. 5, the batting 86, 88, 90 and 92 and foam core assembly 94 are next compressed 80 by passing the assembled layers of batting 86, 88, 90 and 92 and the core assembly 94 through a compression device 96 (shown schematically). The preferred compression device 96 can be purchased by ordering a chain-driven filling machine from James Cash Machine Company of Louisville, Ky.

The preferred compression device 96 includes a plurality of chains 98, 100, 102, 104, 106, 108, 110, 112, 114, 116, 118 and 120 which travel in a machine direction 122. Each pair of chains 98 and 100, 102 and 104, 106 and 108, 110 and 112, 114 and 116, and 118 and 120 travel in opposite directions 124 and 126, respectively. Each opposing pair pulls the batting 86, 88, 90 and 92 and core assembly 94 through the device 96 and compresses the layers 86, 88, 94, 92 and 90 to a thickness that is smaller than the finished product thickness which is preferably about 8 inches.

Figure 6:
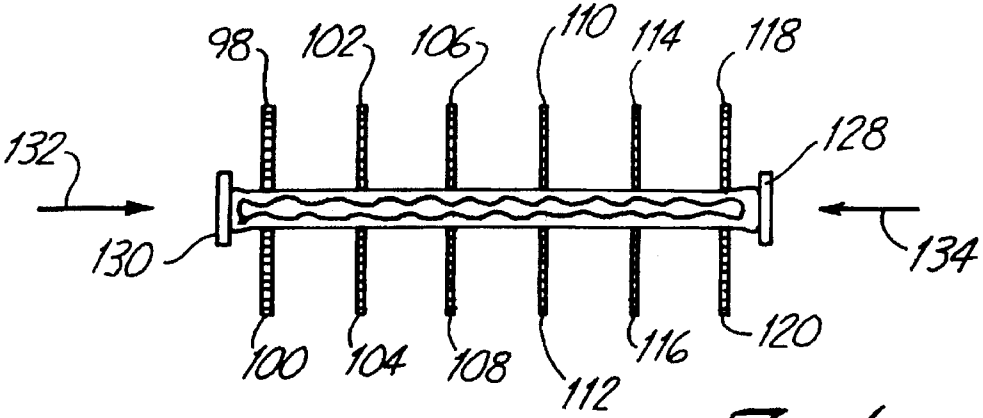
FIG. 6 is a schematic end view of the compression step of the method of the present invention.

Preferably, compression bars 128 and 130 as shown in FIG. 6 are provided to compress the batting 86, 88, 90 and 92 and core assembly 94 in the directions shown by arrows 132 and 134 respectively to enable an operator to insert 82 the foam core 94 and batting 86, 88, 90 and 92 into the casing 136. Preferably, the casing 136 is positioned over the batting 86, 88, 90 and 92 and foam core assembly 94 as the entire assembly exits each pair of chains 98 and 100, 102 and 104, 106 and 108, 110 and 112, 114 and 116, and 118 and 120, respectively.

Next, the casing is closed 84. Most preferably, the casing includes a zipper which extends along an entire longitudinal edge of the futon mattress manufactured by the process described above. Optionally, the futon mattress is tufted. For a full-size mattress of the preferred embodiment, a total of 18 tufts are provided. A suitable tufting machine is available by ordering a "United Automatic Tufting Machine" from United Mattress Machinery, a division of Mathewson Corporation of 86 Finnell Drive, Weymouth, Mass.

Although the present invention has been described with reference to the preferred embodiments, workers skilled in the art will recognize that changes may be made in form and detail without departing from the spirit and scope of the invention.

What is claimed is:

1. A futon mattress foldable from a bed position to a couch position with the futon mattress having a front edge and a second opposite edge located substantially parallel to said front edge comprising:

a layer of batting;

a first elongated end cap, said first elongated end cap formed of a first flexible deformable material resistant to flattening, said first elongated end cap positioned proximate but spaced from said front edge of said futon mattresses by said layer of batting to form a first region of body support that resists flattening over time;

a second elongated end cap said second elongated end cap formed of a second flexible deformable material resistant to flattening said second elongated cap positioned proximate but spaced from said opposite edge of said futon mattress by said layer of batting to form a second region of body support that resists flattening over time;

a cover extending around said layer of batting; and a sheet of compressible material located between said first end cap and said second end cap, said sheet of compressible material having a first set of opposite ends free of end caps that would inhibit folding said sheet of compressible material and a second set of opposite ends holding said first end cap and said second end cap in a spaced apart position within said futon mattress, said sheet of compressible material forming an intermediate region of body support that would normally flattening over time if located at the front edge of said futon mattress, said intermediate region of body support sufficiently compressible to enable said sheet of compressible material to compress sufficiently to form a fold axis which is substantially parallel to said end caps to allow said futon mattress to be folded from the bed position to the couch position so that said first region of body support that resists flattening over time forms a leg support when a user sits on said futon mattress when said futon mattress is in the couch position.

2. The futon mattress of claim 1 wherein said end caps have a generally hemispherical shape to provide gradual increasing body support in the front edge of said futon mattress.

3. The mattress of claim 1 wherein the end cap is formed of a flexible foam having an I.F.D. greater than the density of the sheet of the compressible material.

4. The mattress of claim 1 wherein the end cap is formed of a flexible foam having a density greater than the density of the sheet of the compressible material.

5. The mattress of claim 1 wherein the sheet of compressible material is formed from a flexible foam and has a density between about 0.7 and 1.3 pounds per cubic foot.

6. The mattress of claim 1 wherein the end caps are formed of a flexible foam having a density between about 1.5 and about 2.1 pounds per cubic foot.

7. The mattress of claim 1 wherein at least one of the the end caps are adhesively bonded to the sheet of compressible material.

8. The mattress of claim 1 wherein one of the end caps is adhesively bonded to one of the second set of opposite ends of the sheet of compressible material and the other end cap is adhesively bonded to the the other end of the second set of opposite ends of the sheet of compressible material.

9. The mattress of claim 1 and further comprising a second sheet of compressible material wherein each sheet of compressible material has a substantially flat major surface and a convoluted opposite major surface, wherein each sheet of compressible material is arranged such that the flat major surfaces are face to face.

10. The mattress of claim 1 wherein at least one of the end caps has a contoured outer surface.

11. The mattress of claim 1 and further comprising: a second sheet of compressible material, wherein the sheets have a substantially flat major surface and a convoluted opposite major surface, wherein the sheets are arranged such that the flat major surface are face to face; and wherein each of the end caps has an elongated connecting surface, with the elongated connecting surface of one of the end caps is adhesively attached to the ends of the first and second sheet, and the elongated connecting surface of other end cap is adhesively attached to the other ends of the first and second sheet.

12. The mattress of claim 11 wherein the first and second sheets formed of a compressible material and the first and second end caps are completely encased in the batting.

13. The mattress of claim 11 and further including at least one tuft.

14. The mattress of claim 11 and further comprising two additional layers of batting.

15. A futon mattress foldable from a bed position to a couch position with the futon mattress having a front edge and a second opposite edge located substantially parallel to said front edge comprising:

a layer of batting;

an elongated end cap, said elongated end cap formed of a first flexible deformable material resistant to flattening, said elongated end cap positioned proximate but spaced from said front edge of said futon mattresses by said layer of batting to form a first region of body support that resists flattening over time;

a cover extending around said layer of batting; and a sheet of compressible material located between said end cap and said opposite edge, said sheet of compressible material having at least three ends free of end caps that would inhibit folding said sheet of compressible material with said sheet of compressible holding said first end cap proximate said front edge within said futon mattress, said sheet of compressible material forming an intermediate region of body support that would normally flattening over time if located at the front edge of said futon mattress, said intermediate region of body support sufficiently compressible to enable said sheet of compressible material to compress sufficiently to form a fold axis which is substantially parallel to said end cap to allow said futon mattress to be folded from the bed position to the couch position so that said first region of body support that resists flattening over time forms a leg support when a user sits on said futon mattress when said futon mattress is in the couch position.

* * * * *